US006764063B2

(12) United States Patent
McArthy et al.

(10) Patent No.: US 6,764,063 B2
(45) Date of Patent: Jul. 20, 2004

(54) VALVE SEAL ASSEMBLY WITH BOTTOM FLANGE SEAL

(75) Inventors: Troy Daniel McArthy, Auburn, IN (US); Timothy Alan Hegemier, Avilla, IN (US)

(73) Assignee: Dana Corporation, Toledo, OH (US)

( * ) Notice: Subject to any disclaimer, the term of this patent is extended or adjusted under 35 U.S.C. 154(b) by 232 days.

(21) Appl. No.: 09/777,535

(22) Filed: Feb. 6, 2001

(65) Prior Publication Data

US 2004/0021122 A1 Feb. 5, 2004

(51) Int. Cl.[7] ..... F16K 15/00
(52) U.S. Cl. ..... 251/330; 251/337; 277/313
(58) Field of Search ..... 251/330, 337, 251/214; 123/188.2, 188.6, 90.3, 190.17; 277/313, 407

(56) References Cited

U.S. PATENT DOCUMENTS

| | | | | | |
|---|---|---|---|---|---|
| 897,936 | A | | 9/1908 | Sinkler | |
| 1,490,610 | A | | 4/1924 | Hinkson | |
| 2,180,347 | A | | 11/1939 | Bohuslav | |
| 3,369,819 | A | | 2/1968 | Soo | |
| 3,885,546 | A | * | 5/1975 | Foley et al. | 123/188.6 |
| 4,325,558 | A | | 4/1982 | Poggio | |
| 4,834,037 | A | * | 5/1989 | Lafever | 123/188.6 |
| 5,174,256 | A | * | 12/1992 | Binford | 123/188.6 |
| 6,006,778 | A | | 12/1999 | Kim | |
| 6,205,969 | B1 | * | 3/2001 | McArthy | 123/188.6 |
| 6,244,235 | B1 | * | 6/2001 | Hegemier et al. | 123/188.6 |

* cited by examiner

*Primary Examiner*—Edward K. Look
*Assistant Examiner*—John K. Fristoe, Jr.
(74) *Attorney, Agent, or Firm*—Rader, Fishman & Grauer PLLC

(57) ABSTRACT

A valve stem seal assembly includes an elastomeric sealing member for sealing between a reciprocally moveable valve stem and an associated valve guide in an internal combustion engine. The assembly includes a cylindrical retainer that incorporates an end wall at a first end thereof for securing the elastomeric sealing member to the retainer. The valve assembly is installed over the valve guide, and the retainer is adapted for frictional securement to the guide, whereas the retainer extends down to and engages the surface or deck of the associated engine cylinder head. The retainer includes a radially extending bottom flange at a second end opposite the end wall, wherein the flange bears directly against the cylinder head deck. The upper surface of the flange provides a bearing surface for valve return springs, while the bottom surface of the flange includes an elastomeric sealing media bonded thereto. The sealing media assures positive sealing against oil leakage between the valve guide and the cylinder head deck.

20 Claims, 6 Drawing Sheets

VALVE SEAL ASSEMBLY WITH BOTTOM FLANGE SEAL

BACKGROUND OF THE INVENTION

1. Field of Invention

The present invention relates to valve stem seal assemblies for use in internal combustion engines, and more particularly to sealing media applied to bottom flange portions of such seal assemblies.

2. Description of the Prior Art

Those skilled in the art will appreciate the manner in which intake and exhaust valves are employed in cylinder heads of internal combustion engines. Such valves include integral elongated stems extending away from the engine cylinder heads, the ends of the stems interacting with rotating cams for cyclic repeated opening and closure of the valves during the combustion cycle. The valve stems thus move reciprocally to and from the cylinder head, and so-called valve stem seal assemblies, also variously called oil seal assemblies, are used to seal against leakage of oil through a clearance path between each annular engine valve guide and an associated valve stem supported for reciprocal motion within that particular guide. Obviously, in order to permit unobstructed reciprocal movement of the stem in the guide, some mechanical clearance must exist between the valve guide and the moving stem.

Thus as is well known, the intake ports of a combustion chamber are opened and closed by the reciprocating motion of at least one intake valve, which in turn is driven by the rotary motion of a cam, the latter being affixed to and rotary with an engine camshaft. The intake valve permits fuel mixed with air to flow into the combustion chamber. In addition, an internal combustion engine has at least one exhaust valve and associated exhaust port for releasing expended combustion gases to the atmosphere. Typically, intake and exhaust valves are of the same construction, and include stems integrally affixed to the valves.

In the typical engine, an oil seal assembly is fitted over each valve stem, each assembly being frictionally mounted over an associated valve guide to assure its securement within the engine. Typically each oil assembly has two primary parts; 1) an elastomeric oil seal positioned at one end to control leakage of oil between the valve stem and guide as noted, and 2) a structural cylindrical part called a retainer which is mounted atop of and frictionally secured to the valve guide. In some cases, the retainer has a so-called bottom flange that extends from the top of the valve guide downwardly to the cylinder head deck. As those skilled in the art will appreciate, the cylinder head deck provides support for the bottom flange on which the valve return springs bear. It has long been felt that the spring pressure against the bottom flange has been sufficient to deter or otherwise avoid the usually minor leakages of oil between the valve guide and the cylinder head deck. Thus, while there have been significant advancements in the art with respect to the elastomeric oil seals which engage valve stems, little emphasis has been placed on control of oil leakage between the normally press-fit interface between the valve guide and the engine cylinder head.

The present invention addresses the latter issue.

SUMMARY OF THE INVENTION

The present invention is an improved system for sealing between the valve guide and the cylinder head of an internal combustion engine. A valve stem seal assembly includes a metallic retainer that incorporates a bottom flange for supporting return springs of a reciprocating valve and stem. The bottom flange contains a bonded coating, lip, ring, or other sealing media for the purpose of sealing against leakage of oil between a valve guide positioned in the engine mounting surface, or cylinder head deck. Thus, the inventive sealing media is directed to the interface between valve guide and cylinder head, wherein oil tends to flow down a path between the normally press-fit interface of the noted parts.

The invention contemplates several methods of achieving the so-called bottom flange seal, including screen printing or pad printing of circular elastomeric sealing rings, screen printing or pad printing of an elastomeric sealing grid, rolling an elastomeric sealing coating, or bonding an elastomeric sealing lip to an inside (radially innermost) edge of the annular bottom flange.

The invention thus complements the traditional annular elastomeric seal, which is adapted only to control oil leakage between the valve stem and the valve guide.

DETAILED DESCRIPTION OF THE PREFERRED EMBODIMENTS

Figure 1:
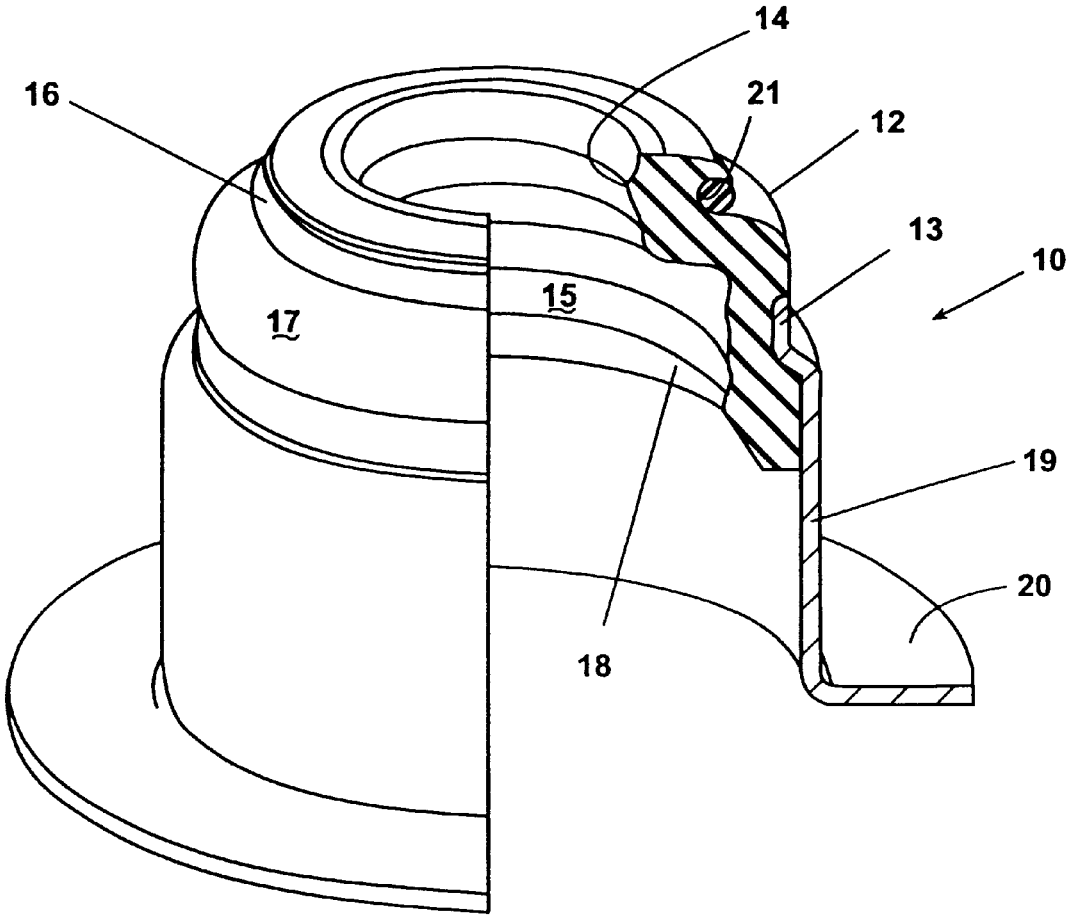
FIG. 1 is a perspective view of one preferred embodiment of the valve stem seal assembly of the present invention, including a cut-away revealing a cross sectional view of the elastomeric seal and metallic retainer incorporated in the preferred embodiment.

Referring initially to FIG. 1, a valve stem seal assembly 10 incorporates an elastomeric seal 12 fixed to an end wall 13 of a cylindrical retainer 19. The seal 12 has a generally cylindrical body that includes interior and exterior surfaces 15 and 17, respectively. The seal 12 is supported in the end wall 13 by means of an exterior groove 21 formed in the exterior surface 17 of the seal body, as revealed in the cut-away portion of FIG. 1. The interior surface 15 of the seal 12 contains a circumferentially extending valve stem sealing lip 14 adapted to engage a stem of a reciprocally movable valve stem assembly, as will be further described. In the preferred form described herein, the seal 12 also incorporates a valve guide seal lip 18 adapted to engage a valve guide, as will also be farther described.

Figure 2:
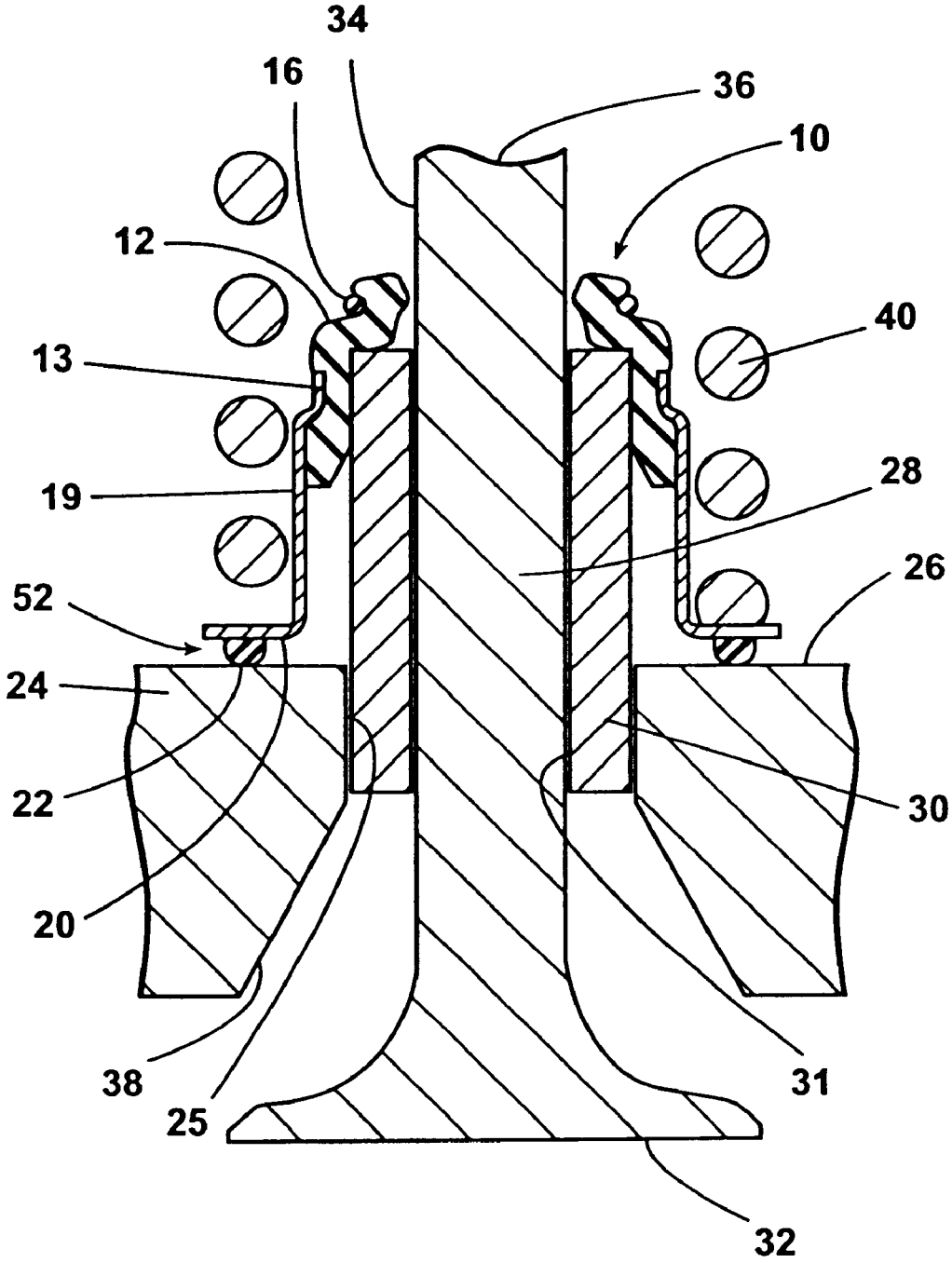
FIG. 2 is cross-sectional view of the valve stem seal assembly of FIG. 1, wherein the seal assembly is shown installed a top of a valve guide extending upwardly from a cylinder head deck, the seal assembly engaging a valve stem in accordance with contemplated usage of the present invention.

Referring now also to FIG. 2, the described valve stem seal assembly 10 is shown installed in an engine. As depicted, the seal assembly is installed over, and is thus frictionally secured to, an annular valve guide 30, which in turn is press fit into, or otherwise frictionally secured within, an aperture 25 that extends through the cylinder head 24. It will be apparent that the valve stem assembly 10 is actually installed over that portion of the valve guide that protrudes above the deck 26 of the cylinder head 24. The stem 34 of a valve assembly 28 is designed to reciprocate within an aperture 31 that extends through the interior of the valve guide 30.

The operation of the valve stem seal assembly 10 and associated valve assembly 28 may now be described as follows. During the operation of an engine (not shown), the combustion process occurs in rapid cyclic fashion. The valve 32 is designed to open and close an intake (or exhaust) valve port 38 at a rate of several times per second. A cam on a camshaft (neither shown) urges a cam actuated free end 36 of the valve stem 34 downwardly in a reciprocal or cyclic manner against the constant force of a valve return spring 40. In accordance with FIG. 2, it will be appreciated that the return spring 40 bears against the upper surface 50 of the bottom flange 20.

To the extent that the combustion process occurs inside of the cylinder head 24, e.g. under the cylinder head deck 26, the valve 32 is positioned nearest the combustion process. Above the cylinder head deck 26 there exists an oily environment, or one subject to "splash and spray oil" as described in the art. As a result, a valve stem seal assembly 10 is needed to assure that oil does not migrate into the area under the valve 32, i.e. the combustion chamber (not shown).

There are two migration paths along which oil may travel into the combustion chamber. The first extends between the valve stem 34 and the elastomeric seal 12. As earlier noted, the annular valve stem sealing lip 14 is the primary gate for deterring oil travel along the first path. It will be noted that a garter spring 16 is disposed in an exterior groove of the seal body 12, circumferentially tensioning the lip 14 against the stem 34 to compensate for wear of the lip over the useful life of the seal assembly. In the presently described embodiment, a valve guide sealing lip 18 is included to prevent oil flow migration past the top surface 33 of the valve guide 30, and down along a path between the exterior surface 35 of the valve guide 30 and the interior surface 15 of the elastomeric seal 12.

Entry into the second migration path is by way of a gap 52, defined by the interface of the deck 26 and the underside 54 of the bottom flange 20. The gap 52 leads to the interface between the valve guide 30 and the aperture 25 extending through the cylinder head 24. Thus the present invention contemplates that an elastomeric sealing media 22 is bonded to the underside 54 of the bottom flange 20 for preventing migration of oil along the described second migration path.

Figure 3:
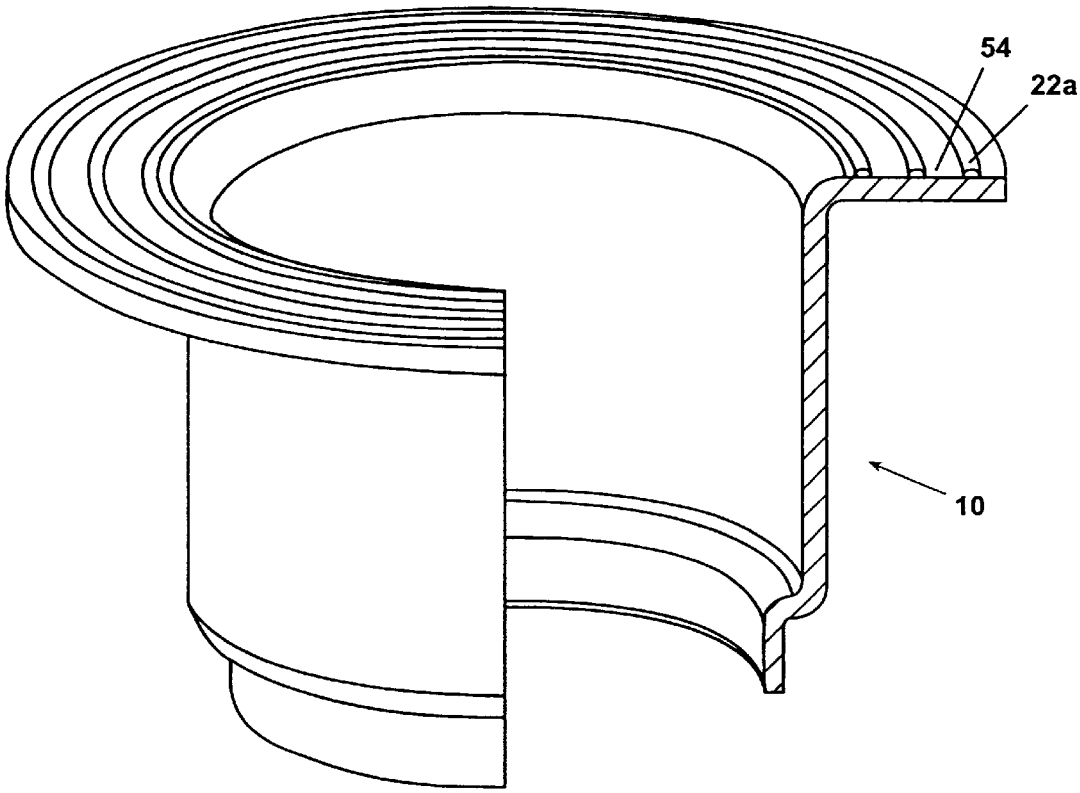
FIG. 3 is a perspective view of the bottom flange of one preferred embodiment of the present invention.

Referring now to FIGS. 3–6, the sealing media 22 is represented in several distinct embodiments. In the embodiment of FIG. 3, a plurality of circular elastomeric sealing rings 22*a* are presented, each ring being circumferentially and uniformly spaced from adjacent rings. Alternatively, the rings could be non-uniformly spaced, as or if determined to be desirable depending on oil migration dynamics.

Figure 4:
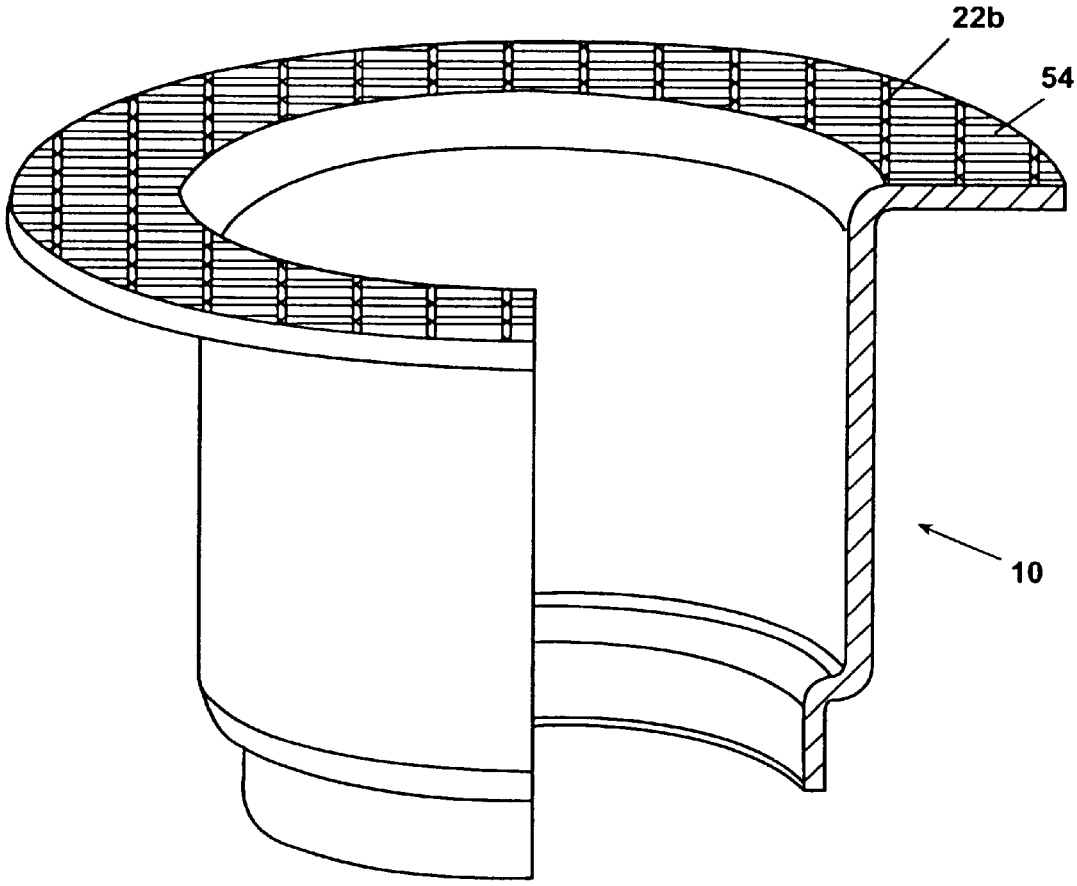
FIG. 4 is a perspective view of another preferred embodiment of the bottom flange.

In the embodiment of FIG. 4, a grid pattern 22*b* is presented wherein an array of rectilinear protuberances of elastomeric media present a waffle pattern for avoiding said described migration of oil through the gap 52. Such pattern could also be formed of a hexagonal or any number of alternative patterns within the scope of this invention.

Figure 5:
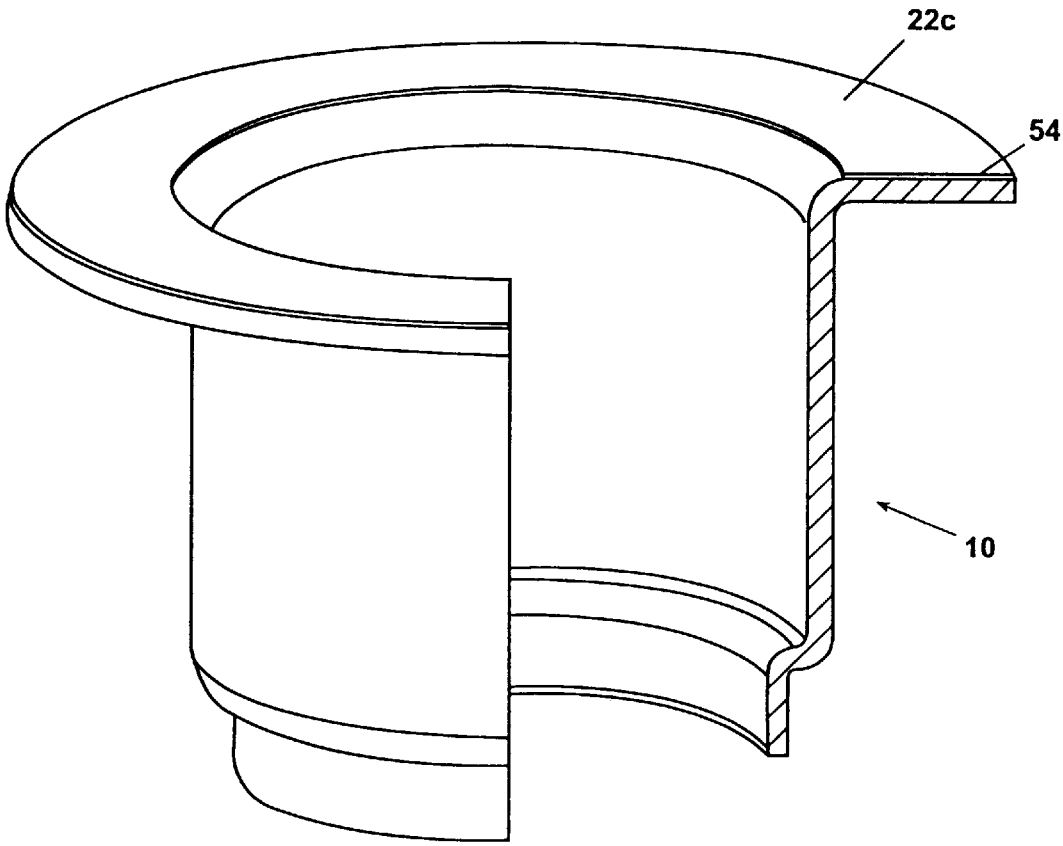
FIG. 5 is still another preferred embodiment of the bottom flange.

The embodiment of FIG. 5 presents a solid layer 22*c* of elastomeric sealing media bonded uniformly (with respect to thickness) over the entire bottom or underside 54 of the flange 20. Depending on the internal pressures and oil migration flow patterns in a given engine, the consistency of the elastomer can be modified with respect to its softness or hardness for achieving an optimal seal.

Figure 6:
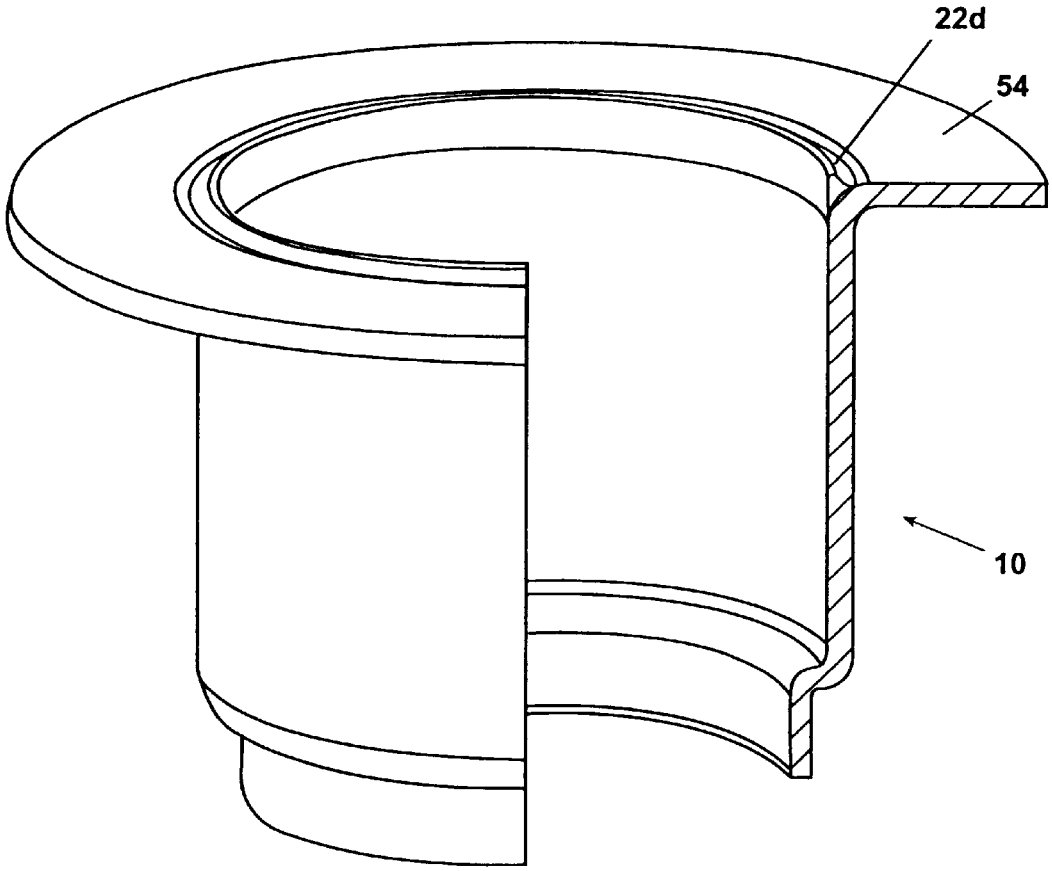
FIG. 6 is yet another preferred embodiment of the bottom flange.

The embodiment of FIG. 6 presents a unitary circumferential sealing lip 22*d* of elastic sealing media located at the interior, or radially innermost, edge of the annular bottom flange 20. It will be apparent to those skilled in the art that numerous other sealing media presentations may be viable or suitable for the desired purpose as described.

Various methods can be employed for applying the elastomeric media 22 to the underside 54 of flange 20. For example, the skilled in the art will appreciate that the sealing rings 22*a* can be screened printed or pad printed onto the underside 54 of the retainer flange 20. The elastomeric sealing grid 22*b* can be also applied by screen-printing or pad printing, but also may be rolled onto the underside 54 of the bottom flange 20. The elastomeric sealing coating 22*c* can be printed by rolling elastomeric material over the entire bottom surface of the flange 20. Finally, the circumferential sealing lip 22*d* can be molded in-situ to the substrate material of the underside 54 of the bottom flange 20. Although the described embodiments of this invention contemplate that the retainer is formed of metal, other materials may be suitable depending upon the harshness of the particular environment. For example, some glass-filled nylons or other plastics may be suitable for some engine environments, wherein in such cases the retainer might suitably be formed of plastic materials.

It is to be understood that the above description is intended to be illustrative and not limiting. Many embodiments will be apparent to those of skill in the art upon reading the above description. Therefore, the scope of the invention should be determined, not with reference to the above description, but instead with reference to the appended claims, along with the full scope of equivalents to which such claims are entitled.

What is claimed is:

1. A valve stem seal comprising a cylindrical retainer having an axis, said retainer having a radially oriented annular end wall integral therewith and defining an upper extremity of said retainer orthogonal to said axis; an annular elastomeric valve stem seal adapted for sealingly engaging a reciprocally movable valve stem; said valve stem seal having a circumferential exterior groove disposed for engaging said annular end wall whereby said seal is fixed to said cylindrical retainer; said cylindrical retainer comprising an outwardly extending radial flange defining its lower extremity wherein the bottom surface of said lower extremity comprises an elastomeric sealing media affixed thereto.

2. The valve stem seal of claim 1 wherein said elastomeric sealing media is affixed to said bottom surface by being bonded thereto.

3. The valve stem seal of claim 2 wherein said retainer is comprised of a plastic material.

4. The valve stem seal of claim 2 wherein said elastomeric sealing media is bonded to said bottom surface by screen-printing.

5. The valve stem seal of claim 1 wherein said retainer is comprised of metal.

6. The valve stem seal of claim 1 wherein said elastomeric sealing media comprises circumferentially spaced sealing rings.

7. The valve stem seal of claim 1 wherein said elastomeric sealing media comprises elastomeric protuberances arrayed in a rectilinear manner to define a grid having an overall appearance of a waffle pattern.

8. The valve stem seal of claim 1 wherein said elastomeric sealing media comprises an elastomeric coating bonded with substantially uniform thickness over the entire bottom surface of said radial flange.

9. The valve stem seal of claim 1 wherein said elastomeric sealing media comprises a unitary circumferential sealing lip bonded to the radially innermost edge of the annular bottom surface of said flange.

10. The valve stem seal of claim 9 wherein said elastomeric sealing lip is bonded in-situ to the radially innermost edge of the bottom surface of said flange.

11. A valve stem seal comprising a cylindrical retainer having an axis, said retainer having a radially oriented annular end wall integral therewith and defining an upper extremity of said retainer orthogonal to said axis; an annular elastomeric valve stem seal adapted for sealingly engaging a reciprocally movable valve stem; said valve stem seal having a circumferential exterior groove disposed for engaging said annular end wall whereby said seal is fixed to said cylindrical retainer; said cylindrical retainer including an outwardly extending radial flange having a bottom surface with an elastomeric sealing media affixed thereto.

12. The valve stem seal of claim 11 wherein said elastomeric sealing media is affixed to said bottom surface by being bonded thereto.

13. The valve stem seal of claim 12 wherein said retainer is comprised of a plastic material.

14. The valve stem seal of claim 12 wherein said elastomeric sealing media is bonded to said bottom surface by screen-printing.

15. The valve stem seal of claim 11 wherein said retainer is comprised of metal.

16. The valve stem seal of claim 11 wherein said elastomeric sealing media comprises circumferentially spaced sealing rings.

17. The valve stem seal of claim 11 wherein said elastomeric sealing media comprises elastomeric protuberances arrayed in a rectilinear manner to define a grid having an overall appearance of a waffle pattern.

18. The valve stem seal of claim 11 wherein said elastomeric sealing media comprises an elastomeric coating bonded with substantially uniform thickness over the entire bottom surface of said radial flange.

19. The valve stem seal of claim 11 wherein said elastomeric sealing media comprises a unitary circumferential sealing lip bonded to the radially innermost edge of the annular bottom surface of said flange.

20. The valve stem seal of claim 19 wherein said elastomeric sealing lip is bonded in-situ to the radially innermost edge of the bottom surface of said flange.

* * * * *